United States Patent [19]

Hoskinson

[11] 4,338,869

[45] Jul. 13, 1982

[54] COMBUSTION APPARATUS UTILIZING AN AUGER HAVING AN INTEGRAL AIR SUPPLY SYSTEM

[75] Inventor: Gordon H. Hoskinson, 1130 Caliente, Jackinsonville, Fla. 32211

[73] Assignee: Gordon H. Hoskinson, Floral Park, N.Y.

[21] Appl. No.: 135,010

[22] Filed: Mar. 31, 1980

Related U.S. Application Data

[62] Division of Ser. No. 573,269, Apr. 30, 1975, Pat. No. 4,231,304.

[51] Int. Cl.[3] ..... F23G 5/12

[52] U.S. Cl. ..... 110/346; 110/257

[58] Field of Search ..... 110/255, 257, 259, 110, 110/346

[56] References Cited

U.S. PATENT DOCUMENTS

| | | | |
|---|---|---|---|
| 3,687,094 | 8/1972 | Menigat | 110/257 |
| 3,942,455 | 3/1976 | Wallis | 110/110 X |
| 4,009,667 | 1/1977 | Tyer et al. | 110/255 X |
| 4,231,304 | 11/1980 | Hoskinson | 110/257 |

FOREIGN PATENT DOCUMENTS

| | | | |
|---|---|---|---|
| 2546801 | 4/1977 | Fed. Rep. of Germany | 110/257 |
| 607110 | 3/1926 | France . | |

*Primary Examiner*—Edward G. Favors

*Attorney, Agent, or Firm*—Andrus, Sceales, Starke & Sawall

[57] ABSTRACT

A combustion apparatus utilizing an auger having an integral air supply system. The apparatus includes a cylindrical combustion chamber containing a rotatable auger. Waste is delivered to one end of the combustion chamber and is conveyed through the chamber by the auger, and ash and the non-combustible residue is discharged from the opposite end while the waste gases are discharged through a cyclone separator to remove fly ash. The auger is composed of a tubular shaft and a hollow spiral flight. Air is introduced into the downstream end of the shaft and flows through the hollow flight and exits through outlet holes in the flight into the combustion chamber. A portion of the air is introduced into the mass of waste being conveyed by the auger to provide primary air for combustion, while a second portion of the air is discharged from the flight into the upper zone of the combustion chamber above the level of the waste, to provide secondary combustion of the waste gases.

4 Claims, 5 Drawing Figures

2
4
10
20
18
14
15
16
1
5
9
7
8
12
48
3
24
23
47
13
22
11
6
65
61
66
62
60
63
59
56
64
57
68
74
75
33
40
43
42
72
34
41
73
76
77

6
2
3
11
7
19
20
26
18
36
37
25
32
35
14
34
68
23
16
69
71
15
10
1

3
11
12
13
22
16
7
20
19
26
25
29
28
30
31
24
55
48
47
54
52
51
46
50
45
44
53
49
70
67
23

COMBUSTION APPARATUS UTILIZING AN AUGER HAVING AN INTEGRAL AIR SUPPLY SYSTEM

This application is a division of application Ser. No. 573,269, filed Apr. 30, 1975 now U.S. Pat. No. 4,231,304.

BACKGROUND OF THE INVENTION

There are two common types of industrial or municipal incinerators. One is a continuous feed system in which waste material is continuously fed to the combustion chamber and non-combustibles are continuously discharged, and the other is a starved air system which operates on batch principles.

The continuous feed incineration system includes a series of grates which supports the waste and air is passed upwardly through the grates into contact with the waste material, while the ash and non-combustible materials pass downwardly through the grates and are collected in a water filled trough. Waste is normally a low energy heat source, and as a result, certain materials such as glass, plastics, and lower melting point alloys, will melt and form a slag which is apt to clog the grates and prevent air from passing through the grates into the mass of waste material. To counteract this, the conventional continuous feed system normally will include a mechanism for agitating or moving the grates to dislodge the slag and permit air to pass upwardly into the waste material.

It has been found that in the conventional continuous feed system, up to 30% of the combustible material may pass through the grates along with the ash and non-combustible materials, thereby substantially reducing the efficiency of the system.

Because of the problem in introducing adequate air through the grates into the waste material the conventional continuous feed unit requires a relatively large volume combustion chamber in order to adequately burn the combustible waste gases. As the waste gases normally contain a substantial quantity of fly ash, the conventional procedure is to pass the waste gases through a scrubber where the gases pass through a tortuous path and are subjected to a water spray which acts to wash out the fly ash particles.

As a further disadvantage, the conventional continuous feed system will not adequately burn waste material that contains substantial quantities of water or moisture.

Furthermore, expensive and sophisticated controls are required with the process to monitor various conditions in the system. For example, controls are required to monitor the air pressure in the combustion chamber to determine whether the grates are partially clogged, and to monitor the temperature in the combustion chamber and thereby control the air input through the grates to obtain proper burning. Furthermore, temperature conditions in the scrubber are required to be monitored in order to control the amount of water added to the scrubber. Because of the complexity of the controls, the cost of the incinerator is substantial, so that in many cases other waste disposal systems, such as land fill systems, have been used rather than an incinerator.

The starved air type of incinerator is a batch system in which air is injected in minimum quantities and does not utilize mechanical grates. With the starved air system there is no agitation of the waste material within the combustion chamber, except for the introduction of new waste material. As a consequence, the starved air system is generally used only for dry materials, for dense compacted materials, or water laden materials, will not adequately be combusted due to the lack of agitation in the combustion chamber.

In the conventional starved air system, waste gases are normally carried off to a secondary combustion chamber, so that less fly ash is developed, as compared to a continuous feed system.

However, the starved air system has distinct drawbacks; the primary one being that the system is a batch type in which the ash and non-combustible materials remain in the combustion chamber and must be cleaned out of the combustion chamber after the burn out is complete. Moreover, the starved air system is generally a small volume unit and is limited to relatively dry material. The system does not adequately burn plastics, asphalt-based materials, or other wastes that will melt before they burn, as materials of this type will produce a solidified slag or mass in the combustion chamber.

SUMMARY OF THE INVENTION

The invention is directed to an improved, continuous feed, industrial or municipal combustion system which does not require the use of a grate mechanism, as in the conventional continuous feed system. In accordance with the invention, the combustion apparatus comprises a cylindrical combustion chamber that contains a rotatable auger. The waste material is delivered to one end of the combustion chamber and is conveyed through the combustion chamber and agitated by the auger. The ash and non-combustible materials are discharged from the opposite or downstream end of the combustion chamber, while the gases generated from the combustion process are passed through a heat exchanger and then discharged through a cyclone separator to remove any traces of fly ash.

The auger includes a tubular shaft and a hollow sprial flight which is carried by the shaft. Air is introduced into the downstream end of the hollow shaft and passes into an air passage which extends continuously through the spiral flight. A series of outlet ports are formed along the length of the flight, and air passes from the hollow interior of the flight into the combustion chamber.

The auger acts to slowly convey and agitate the waste material through the combustion chamber. The air is not only discharged within the mass of the combustible material being conveyed by the auger, but is also discharged through the flight into the upper portion of the combustion chamber where it serves to burn the waste gases of combustion in a secondary combustion zone. This results in a substantially complete burning of all the solid combustible material, as well as the combustible waste gases.

A gas burner is associated with the inlet end of the combustion chamber and serves to initially ignite the waste materials. Once the combustion has been well established, the burner can be shut off and the heat generated by the burning of the waste material will continue the combustion process without auxilliary heat input.

As a further feature of the invention, the hollow auger flight is provided with a water passage which extends continuously the length of the flight and water is introduced into the water passage through a pipe which extends within the hollow auger shaft. The water serves to cool the auger. During the combustion process, the water is converted to steam and the steam is discharged from the auger shaft.

The combustion system of the invention is a continuous system in which waste material is automatically fed into the combustion chamber and ash and other non-combustible materials are continuously discharged from the combustion chamber.

The combustion apparatus can burn a wide variety of products, including wet or water soaked material, such as garbage, animal manure, weeds, leaves, and the like. In addition, finely divided or powdery products such as sawdust, peanut hulls, coffee grounds, plastic scraps, can also be completely combusted.

The combustion apparatus has improved efficiency over conventional types in that no steam, combustible waste gases or fly ash, will be discharged from the system so that it meets all pollution standards. The unit can produce a substantial amount of heat energy which can be utilized to generate steam or can be used in other industrial or commercial applications.

The combustion apparatus has considerable less weight than conventional municipal industrial incinerators and when mounted on a mobile foundation or platform can be moved from site to site.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
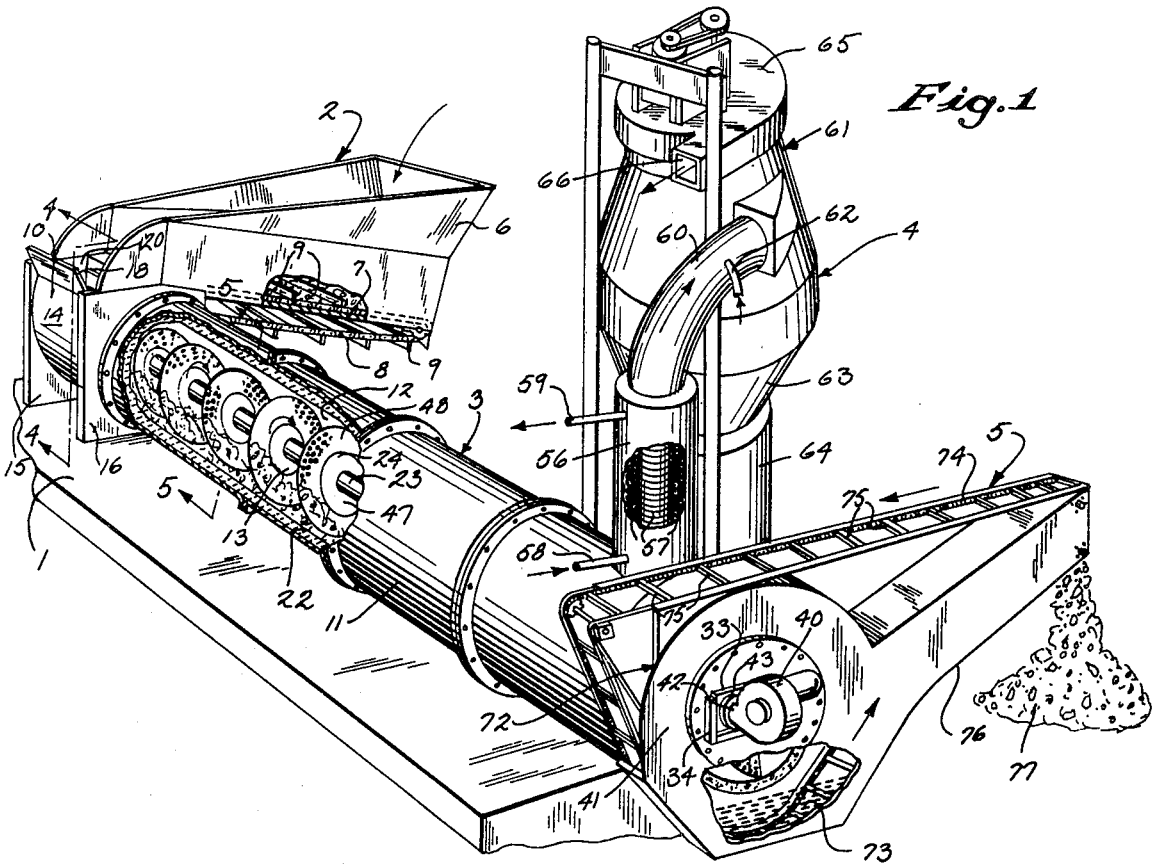
FIG. 1 is a perspective view with parts broken away showing the combustion apparatus of the invention.

The combustion apparatus of the invention is mounted on a foundation 1, and, in general, includes a waste feed unit 2, an auger combustor unit 3, a waste gas treatment unit 4, and an ash and non-combustible removal unit 5. The waste material is introduced into the waste feed unit 2, which conveys the waste into the inlet end of the combustor unit 3 where the combustible materials are burned and the ash and non-combustible materials are discharged through the ash removal unit 5. The gases resulting from the combustion process pass through the gas treatment unit 4 and are ultimately discharged to the atmosphere.

The feed unit 2 includes a hopper 6 having an upwardly inclined bottom surface 7. A standard chain type conveyor 8 is associated with the hopper 6 and includes a series of cleats or cross members 9 that ride on the bottom surface 7. Waste material dumped into the hopper 6 is conveyed upwardly along the bottom surface 7 by the cleats 9 and is discharged into the combustor unit 3.

The auger combustor unit 3 comprises an inlet section 10, which receives the waste from the feed unit 2, and a cylindrical housing 11 that defines a combustion chamber 12. An auger 13 is disposed within the inlet section 10 and housing 11 and serves to convey the waste material through the combustion chamber.

Figure 4:
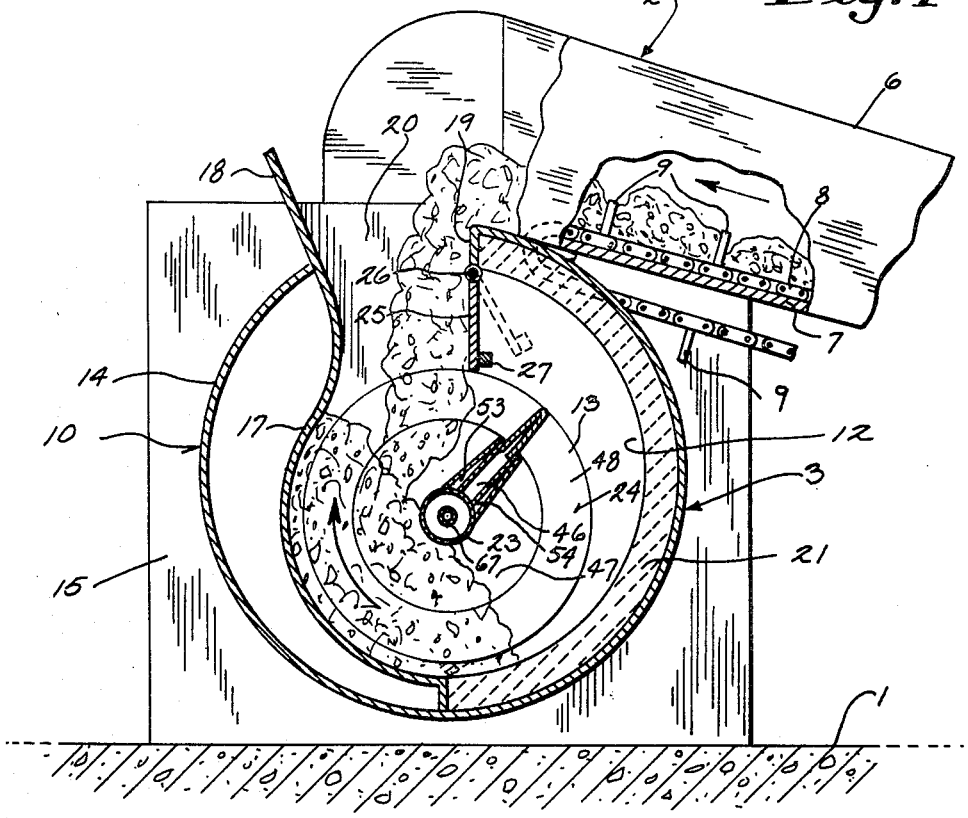
FIG. 4 is a section taken along line 4—4 of FIG. 3.

The inlet section 10 includes a partially cylindrical shell 14, one end of which is enclosed by a vertical end plate 15. A second vertical plate 16 is spaced from end plate 15 and is located at the junction between the inlet section 10 and housing 11. As shown in FIG. 4, a baffle plate 17 is spaced inwardly of the shell 14 and is provided with a downwardly extending flange that is welded to the bottom portion of shell 14. The upper end of baffle 17 extends upwardly beyond the upper extremity of shell 14 and forms a deflector 18 which aids in deflecting the waste into the interior of the shell 14.

The upper portion of shell 14 is provided with a flange 19 that is spaced from baffle 17 to provide an inlet opening 20 for the waste. The portion of shell 14 extending downwardly from the upper flange 20 to the baffle 17 is lined with refractory material 21.

The housing 11 is formed of a series of sections **11*a* having mating circumferential flanges which are joined together to provide the cylindrical housing. The inner surface of the housing 11 is lined with a conventional refractory material 22**.

Figure 5:
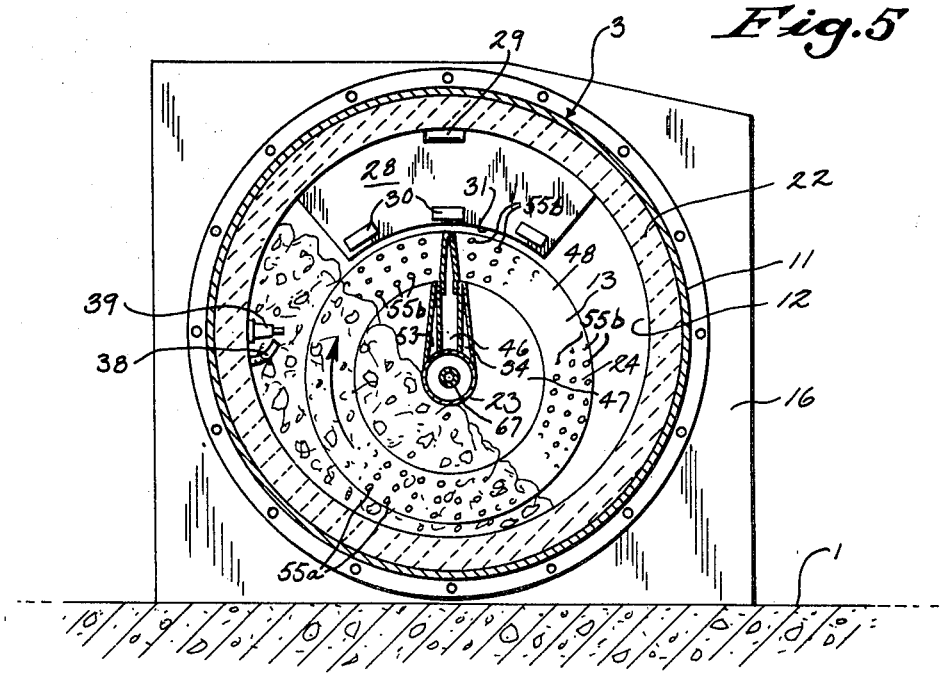
FIG. 5 is a section taken along line 5—5 of FIG. 3.

The auger 13 includes a tubular shaft 23 which carries a hollow spiral flight 24. As best shown in FIG. 5, the lower peripheral edge of the flight 24 is spaced slight above the refractory lining 22, while the upper peripheral edge of the flight is spaced a greater distance from the lining 22, so that the auger is not axially aligned with the housing 11.

The inlet section 10 is provided with a pivoted baffle plate 25 which is pivoted by pin 26 to the flange 19. The baffle 25 is biased to a vertical position by a weight 27 which is attached to the lower end of the baffle plate. The lower edge of baffle plate 25 is spaced slightly above the peripheral edge of the spiral flight 24 so that the baffle plate will not interfere with rotation of the auger. However, the baffle plate 25 can pivot upwardly to accommodate large chunks of waste being moved by the auger.

A second baffle plate 28 is pivoted by pin 29 to the vertical plate 16 and is positioned above the auger 13. The lower end of baffle 28 is provided with a weights 30, which act to bias the baffle to a vertical position, and the lower edge of the baffle is curved, as indicated by 31, to conform to the curvature of the auger flight 24. The baffle 28 percents large volumes of air from passing from the atmosphere into the combustion chamber 12 when the inlet section 10 is not filled with waste. However, the baffle 28 can pivot under the pressure of larger chunks of waste to permit the chunks to pass into the combustion chamber 12.

The auger is rotated in the direction of the arrow, as shown in FIG. 4, and the waste is conveyed upwardly along the bottom surface 7 of the hopper 6 and is discharged into the opening 20. Baffles 17 and 25 along with the location of the inlet opening 20 aid in preventing the waste material from clogging the entrance to the auger.

Figure 2:
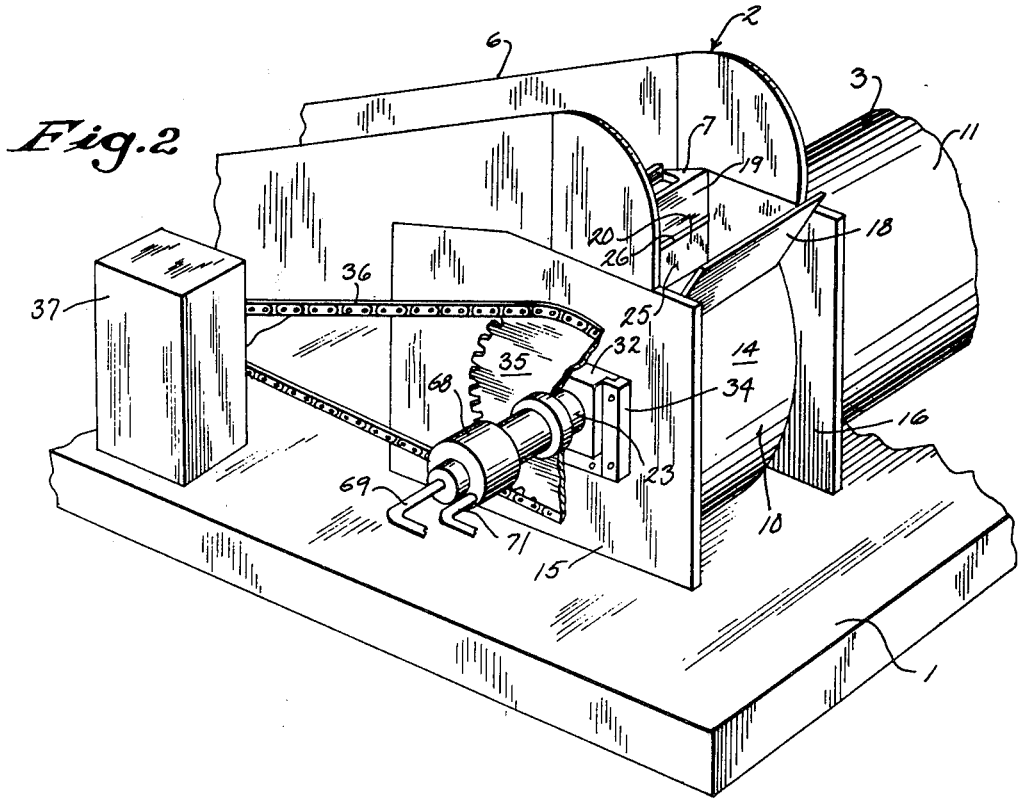
FIG. 2 is a perspective view of the inlet or upstream end of the combustion apparatus.

The shaft 23 of auger 13 is journalled for rotation by a pair of bearing blocks 32 and blocks 33, each of which is mounted for vertical movement within guides 34. One pair of guides 34 is secured to the end plate 15 and receives the bearing block 32, as best shown in FIG. 2, while the other pair of guides 34 is secured to the ash removal unit 5 and receives the bearing block 33. This floating type of mounting of the auger shaft 23 permits the shaft to move vertically if large hard chunks or masses of waste material are encountered by the rotating auger.

To drive the auger, a sprocket 35 is attached to the shaft 23 outwardly of the bearing block 32 and the sprocket 30 is connected by a chain 36 to the output shaft of a hydraulic variable speed drive unit 37. With this drive system, the speed of rotation of the auger can be varied as desired.

To initially begin combustion of the waste material, a conventional gas burner 38 and igniter unit 39 are mounted in the housing 11 adjacent the inlet section 10. After a period of about 15 minutes, when the combustion of the waste material has been fully established, the heat generated by the burning of the combustible material will be sufficient to carry on the process so that the operation of the burner unit 38 can be discontinued.

Figure 3:
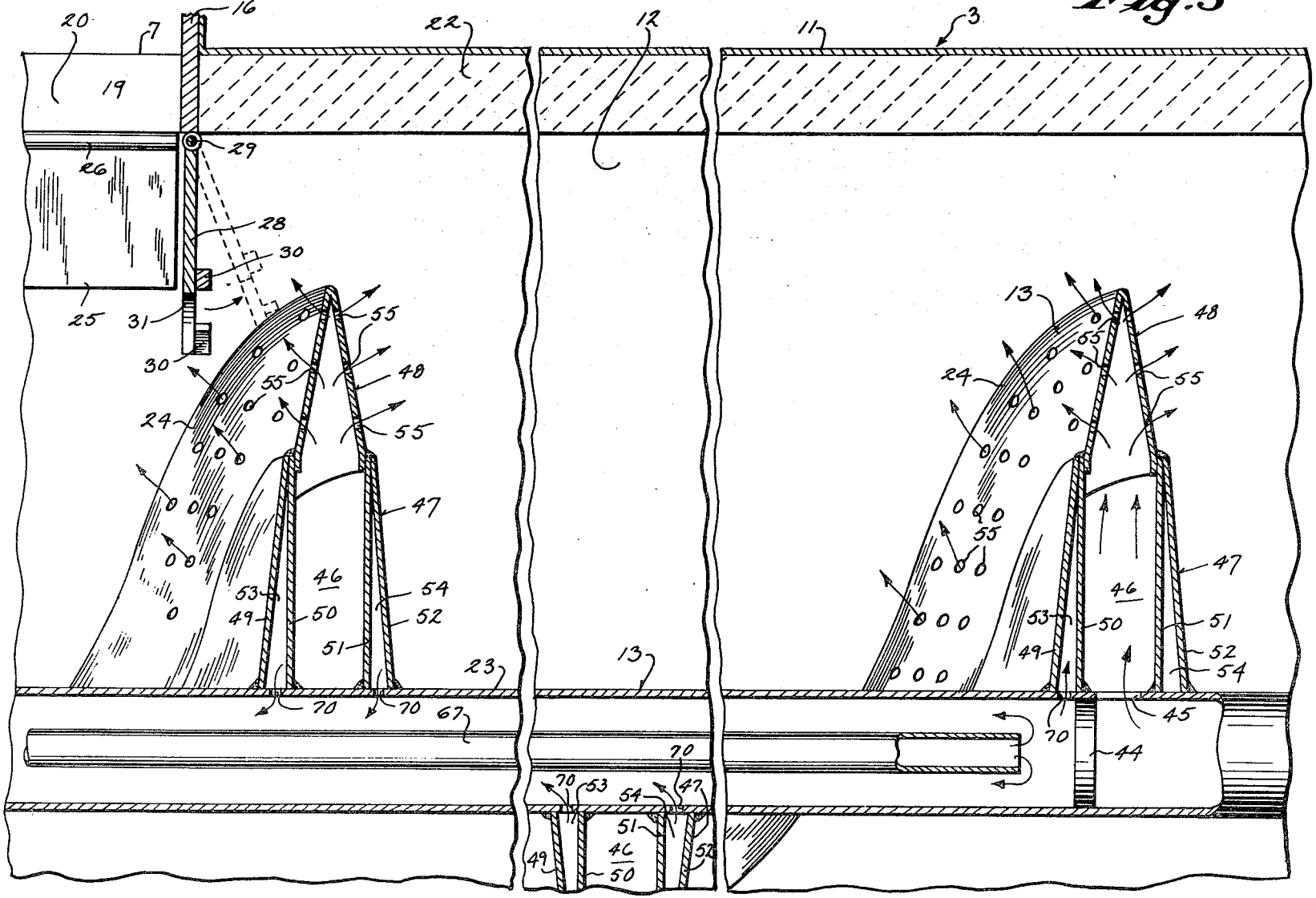
FIG. 3 is a fragmentary longitudinal section of the auger combustor unit.

In accordance with the invention, air is introduced into the downstream end of the hollow auger shaft 23 and passes through the hollow interior of the flight 24 and is discharged from the flight into the interior of the housing 11. To supply the air for the combustion process, a blower unit 40 is mounted on the end plate 41 of ash removal unit 5 and has an outlet 42 connected by swivel coupling 43 to the end of the auger shaft 23, so that air from the blower will be discharged into the interior of the shaft. As best shown in FIG. 3, a plug 44 is mounted within the interior of shaft 23 adjacent the downstream end of the flight 24, so that the air entering the shaft cannot flow the length of the shaft. The shaft, however, is provided with one or more openings 45 which provide communication between the portion of the interior of the shaft, located downstream of plug 44, and a central passage 46 in the flight 24. The passage 46 extends continuously throughout the length of the flight, and air entering the passage 46 will flow counter-current to the travel or flow of the waste material in the combustion chamber 12.

As best illustrated in FIG. 3, the flight 24 is composed of an inner section 47 and a generally V-shaped outer section 48. The inner section 47 is preferably formed of steel, while the outer section is made of cast iron and has the ability to withstand the operating temperatures encountered in the auger combustor. The outer section 48 can be connected to the inner section by bolts, welding, or the like.

Inner section 47 is composed of a series of plates 49–52, and the plates 49 and 50 are connected at their outer extremities and define a passage 53, while plates 51 and 52 are connected at their outer extremities and define a passage 54. As illustrated in FIG. 3, the air passage 46 extends radially through both sections 47 and 48.

The outer section 48 is provided with a series of outlet ports 55 and air within the central passage 46 is discharged through the ports 55 into the combustion chamber 12. As shown in FIG. 5, the waste material being conveyed by the flight 24 will tend to be concentrated along the side of the housing 11. A portion of the air being discharged through the ports **55*a* will be directed into the mass of waste material being conveyed by the auger to thereby aid in agitating the waste material and providing more efficient combustion. In addition, a second portion of the air discharged from the ports 55*b* will be delivered into the upper portion of the combustion chamber 12, above the level of waste therein. The air being discharged into the upper portion of the combustion chamber through ports 55*b*** will serve to burn the waste gases of combustion in a secondary combustion zone, thereby providing complete combustion of the combustible solids and gases so that no smoke is generated and no afterburner is required.

The ports 55 are spaced along the portion of the length of the auger 13 which is located in the combustion chamber 12. While the drawings show the ports 55 as being equally spaced along the flight 24, the particular spacing, shape and arrangement of the ports is not critical, although the ports should be distributed throughout the combustion zone.

The auger flight 24 serves to separate the combustion chamber into a series of small combustion zones and air is introduced into the waste in each combustion zone through the ports 55. Air being discharged through the ports 55 will generate sparks at the port and the sparks, moving with the flow of the gases in the upper portion of the combustion chamber, will tend to seed or ignite uncombusted portions of the waste material.

The air passing counter-currently through the passage 46 within the auger flight will be heated, so that the air being discharged from the ports 55 at the upstream end of the combustion chamber 12 will be at a higher temperature than air being discharged through the ports 55 at the downstream end of the combustion chamber, thereby aiding in the combustion of the new waste material being introduced into the upstream end of the combustion chamber.

Furthermore, the air pressure in passage 46 will be greater at the downstream end of the combustion chamber and will be less at the upstream end. This is an advantage in that the high air pressure cannot blow out the flame at the downstream end where the combustion is well established, while the high pressure air could possibly blow out the flame at the upstream end.

The auger 13 conveys the waste material through the combustion chamber and constantly agitates the material and exposes new unburned surfaces to the air being discharged through the ports 55. During the combustion process, the liner 22 will be lubricated with ash so that molten glass, metal and plastic will not stick to the refractory liner.

The resulting gaseous products of combustion are discharged from the combustion chamber 12 into a heat exchanger 56 which is a conventional type. As shown in FIG. 1, the heat exchanger includes a group of concentric, spirally wound tubes 57, through which water is passed and the gases from the combustion chamber passing around the tubes 57 will heat the water to generate steam. Water is introduced into the heat exchanger 56 through line 58 and steam is withdrawn through line 59.

The gases being discharged from the heat exchanger 56 will then flow through the conduit 60 to a cyclone separator 61. Water is introduced into the conduit 60 through a line 62, and because of the high velocity of the gases passing within the conduit 60, the water virtually explodes and is transformed to mist. The introduction of water serves a dual function in that it not only cools the gases to protect the cyclone separator, but also moistens any fly ash in the gas with water, making the fly ash more dense and thus more easily removed by the cyclone separator.

The cyclone separate 61 is a conventional type and includes a downwardly tapered housing 63 which terminates in a collection bin 64, and a blower 65 that is mounted on the top of the housing. The heavy fly ash particles are more dense than the gases and fall downwardly within the housing 63 while the gases are discharged through the blower outlet 66 to the atmosphere.

One or more heat exchangers 56 and separators 61 can be employed depending on the size of the installation.

The invention also has a provision for cooling the auger flight 24. As previously noted, the plates 49 and 50 define a passage 53, while the plates 51 and 52 define a second passage 54. Passages 53 and 54 extend substantially the full length of the flight 24 and are located on opposite sides of the central air passage 46. Water is introduced into the passages 53 and 54 by means of a water pipe 67 which is located centrally of the auger shaft 23. The outer end of the water pipe 67 is connected by a swivel connection 68 to an inlet water line 69, as shown in FIG. 2. The swivel connection 68 permits the auger shaft 23 and pipe 67 to rotate relative to the water line 69.

The downstream end of the water pipe 67 terminates adjacent the plug 44 and the water being discharged from the downstream end of the pipe will then pass into the interior of the auger shaft. Holes 70 provide communication between the interior of the shaft and the passages 53 and 54, so that the water will flow through the passages toward the upstream end of the combustion chamber 12. During the combustion process, the water will be heated and steam will be generated and the steam is discharged from the space between the auger shaft 22 and pipe 63 through a line 71. Line 71 is also connected by swivel coupling 68 to the auger shaft.

With this construction, water is introduced into the interior of the auger shaft and passes into the passages 53 and 54 in the flight 23. Steam and/or water is withdrawn from the interior of the shaft 23 through the line 71.

Ash and other non-combustible materials are discharged from the downstream end of the combustion chamber 12 by auger 13 to the ash removal unit 5 which includes a housing 72 that is located at the end of the housing 11. The lower portion of the housing 72 defines a water filled collection trough 73 and ash and non-combustible materials are discharged into the trough 73.

A standard slat-type conveyor 74 having a series of cross members or cleats 75 is mounted for travel with respect to the housing 72. The conveyor 74 moves in an endless path and cleats 75 act to move the ash and other non-combustible material from trough 74 up the incline 76 and discharge the ash and non-combustibles into a collection area 77.

The combustion apparatus of the invention is a continuous system in which waste material is continuously introduced into the combustion chamber and ash and non-combustible residue is continuously discharged at the opposite end. The use of the novel auger construction in conjunction with the air supply system enables air to be continuously supplied beneath the level of the waste material, and the rotating auger provides constant agitation of the waste material to present new surfaces for burning. Furthermore the discharge of air from the flight 24 into the portion of the combustion chamber, above the level of the waste, provides a secondary combustion zone for the combustible waste gases so that there is no smoke being discharged from the apparatus, thereby eliminating the need of an afterburner.

The improved efficiency brought about by the use of the auger in conjunction with the air supply mechanism enables the combustion apparatus to effective burn wet or moist materials, such as garbage, manure, leaves, and the like, as well as finely divided powdery materials, such as sawdust, plastic fines, peanut shells, etc.

The combustion apparatus is considerably less complex than normal industrial or municipal incinerators and the use of sophisticated monitoring controls is eliminated. The only control required is the auger speed control which can be adjusted to increase or decrease the length of time the waste material is in the combustion chamber.

As the combustion apparatus is relatively light in weight compared to the normal industrial or municipal incinerator it can be mounted on a mobile base and moved from one site to another.

Various modes of carrying out the invention are conatemplated as being within the scope of the following claims particularly pointing out and distinctly claiming the subject matter which is regarded as the invention.

I claim:

1. A method of burning combustible waste material comprising the step of feeding waste material into an elongated combustion chamber, igniting the waste material, moving the ignited waste material through the chamber with a rotating screw conveyor having a hollow flight and having a plurality of ports providing communication between the interior of the hollow flight and the chamber, and introducing air into the hollow interior of the flight and discharging the air through said ports into the interior of the mass of waste material and into the upper portion of the combustion chamber above the level of the waste material to provide a secondary zone of combustion for combustible waste gases.

2. The method of claim 1, and including the step of cooling the spiral flight by contacting the flight with a cooling medium.

3. A method of burning combustible waste material, comprising the steps of feeding waste material into an elongated combustion chamber, igniting the waste material, moving the waste material through the chamber with a rotating screw conveyor having a spiral flight containing separate first and second internal passages, said flight also having a plurality of ports providing communication between said first passage and the combustion chamber, introducing air into the first passage and discharging the air through said ports into contact with the waste material throughout substantially the entire length of the chamber, and flowing a cooling medium through the second passage to cool the screw conveyor.

4. The method of claim 3, and including the step of flowing the air through said first passage in a countercurrent direction with respect to the movement of the waste material through said chamber.

* * * * *